United States Patent [19]

Roberson

[11] Patent Number: 4,823,717

[45] Date of Patent: Apr. 25, 1989

[54] DECK CONNECTION SYSTEM FOR A BOAT

[75] Inventor: Robert F. Roberson, San Clemente, Calif.

[73] Assignee: Hot Sports, Inc., Corona del Mar, Calif.

[21] Appl. No.: 169,029

[22] Filed: Mar. 15, 1988

[51] Int. Cl.[4] ..... B63B 1/12

[52] U.S. Cl. ..... 114/61; 114/352; 114/283

[58] Field of Search ..... 114/61, 85, 352, 283, 114/292

[56] References Cited

U.S. PATENT DOCUMENTS

| | | | |
|---|---|---|---|
| 3,141,435 | 7/1964 | Moffitt | 114/61 |
| 3,883,909 | 5/1975 | Fisher et al. | 114/61 |
| 3,965,513 | 6/1976 | Horiuchi | 114/352 |
| 4,437,424 | 3/1984 | Lord | 114/61 |
| 4,624,209 | 11/1986 | Loffler | 114/61 |
| 4,715,306 | 12/1987 | Horais | 114/61 |

*Primary Examiner*—Sherman D. Basinger
*Assistant Examiner*—Thomas J. Brahan
*Attorney, Agent, or Firm*—Morland C. Fischer

[57] ABSTRACT

A system for detachably connecting a wing to a pair of spaced hollow hulls to complete a deck assembly for a boat, such as a catamaran. Each hull has an upwardly extending, open ended hatch cone which communicates with the hull interior. The hatch cones are received through respective hatch openings formed at opposite sides of the wing for aligning the wing with the hulls. Each hull has a plurality of holes formed therethrough which are aligned with a corresponding plurality of receptacles located in the bottom of the wing. Fasteners are removably inserted through respective holes in the hull for receipt by the receptacles of the wing, whereby the wing is detachably connected to the hulls. The fasteners are located through the holes and into the receptacles from the interior of the hollow hulls and by way of the open ended hatch cones which communicate therewith.

14 Claims, 3 Drawing Sheets

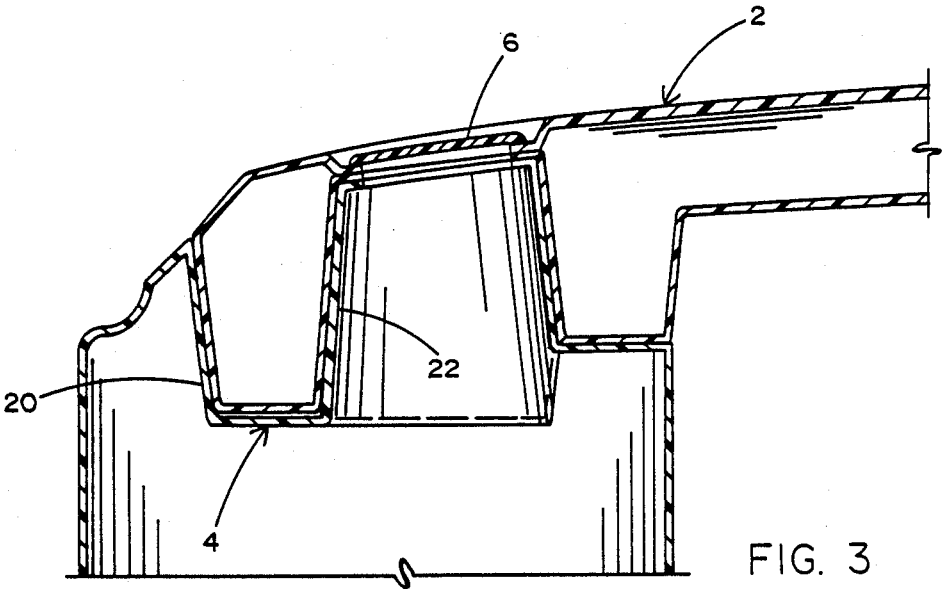
FIG. 3
FIG. 4
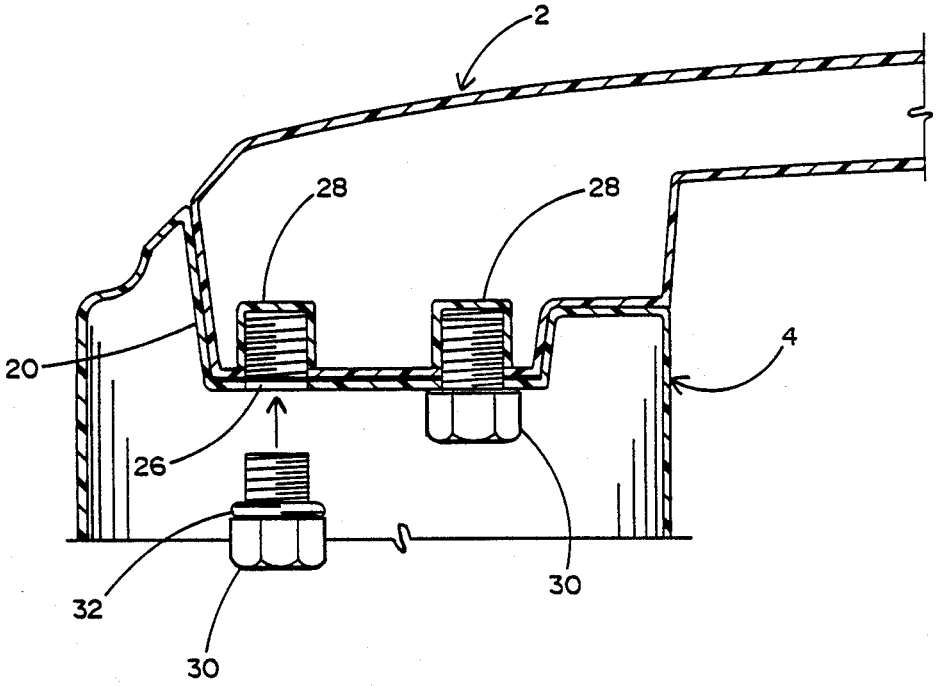

DECK CONNECTION SYSTEM FOR A BOAT

BACKGROUND OF THE INVENTION

1. FIELD OF THE INVENTION

This invention relates to a system for detachably connecting a relatively rigid, non-deformable wing to a pair of spaced, hollow hulls from the interior of said hulls, whereby to complete a deck assembly for a boat, such as a catamaran.

2. PRIOR ART

Certain sailboats, such as catamarans, or the like, are known to have a pair of spaced hulls, and a flexible trampoline which extends between and is connected to the hulls. The conventional trampoline is usually tied between and supported by a pair of parallel aligned front and rear tubes. Such a trampoline is typically formed from a cord-like, lattice material which produces an undesirable spring-like effect when walked or sat upon.

That is to say, the flexible trampoline is subjected to torsion and torque producing forces generated by the sea. These forces, when not suitably dampened, may make walking or sitting on the conventional wing difficult and/or uncomfortable. Moreover, the aerodynamic and hydrodynamic characteristics of the sailboat may be adversely affected by the presence of the flexible trampoline and the failure to probably absorb such torsion and torque producing forces. As will also be known to those skilled in the art, it is frequently difficult and often time consuming to detach the conventional flexible trampoline from the pair of hulls, such as when transport or storage of the sailboat is desirable. Moreover, special tools are often needed to accomplish the trampoline removal. What is still more, the conventional flexible trampoline is known to permit water to penetrate the latice material thereof. Hence, passengers of the sailboat are more likely to get and remain wet, even during relatively mild sea conditions.

SUMMARY OF THE INVENTION

In general terms, this invention relates to a system for accurately aligning a wing with and connecting said wing to a pair of spaced, hollow hulls to form the deck assembly of a sailboat, such as a catamaran. The wing is preferably formed from a relatively rigid, non-deformable material and extends between the pair of hulls.

Each hull has a recessed saddle which is dimensioned to receive and support an opposite side of the wing. A hollow, open ended hatch cone extends upwardly from the saddle of each hull and communicates with the hull interior. A hatch opening is formed through each side of the wing. The hatch cones are received through respective hatch openings for aligning the wing with the hulls between the saddles. Removable hatch covers are located atop each hatch cone to block access to the interior of the hulls via the cones.

A plurality of holes extend through the saddle of each hull. A corresponding number of receptacles extend from the bottom and partially through the wing in alignment with the holes of the saddles. Non-metallic fasteners (e.g. bolts) are removably inserted through respective holes of the saddles for receipt within the receptacles at the bottom of the wing by which to detachbly connect the wing to the hulls. The fasteners are inserted through the holes of the saddles from a location at the interior of the hulls. With the hatch covers removed from the open ended hatch cones, access to the hull interiors is gained by way of the hatch cones which communicate with said interiors. Accordingly, a reliable, easily accessible, and non-obtrusive deck aligning and connecting system is available, wherein the fasteners, which extend between the hulls and the bottom of the wing, are not visible from the top of the deck so as to streamline and improve the aesthetic appearance thereof.

BRIEF DESCRIPTION OF THE DRAWINGS

FIG. 3 is a cross section taken along lines 3—3 of FIG. 2; and

FIG. 4 is a cross section taken along lines 4—4 of FIG. 2.

DESCRIPTION OF THE PREFERRED EMBODIMENT

Figure 1:
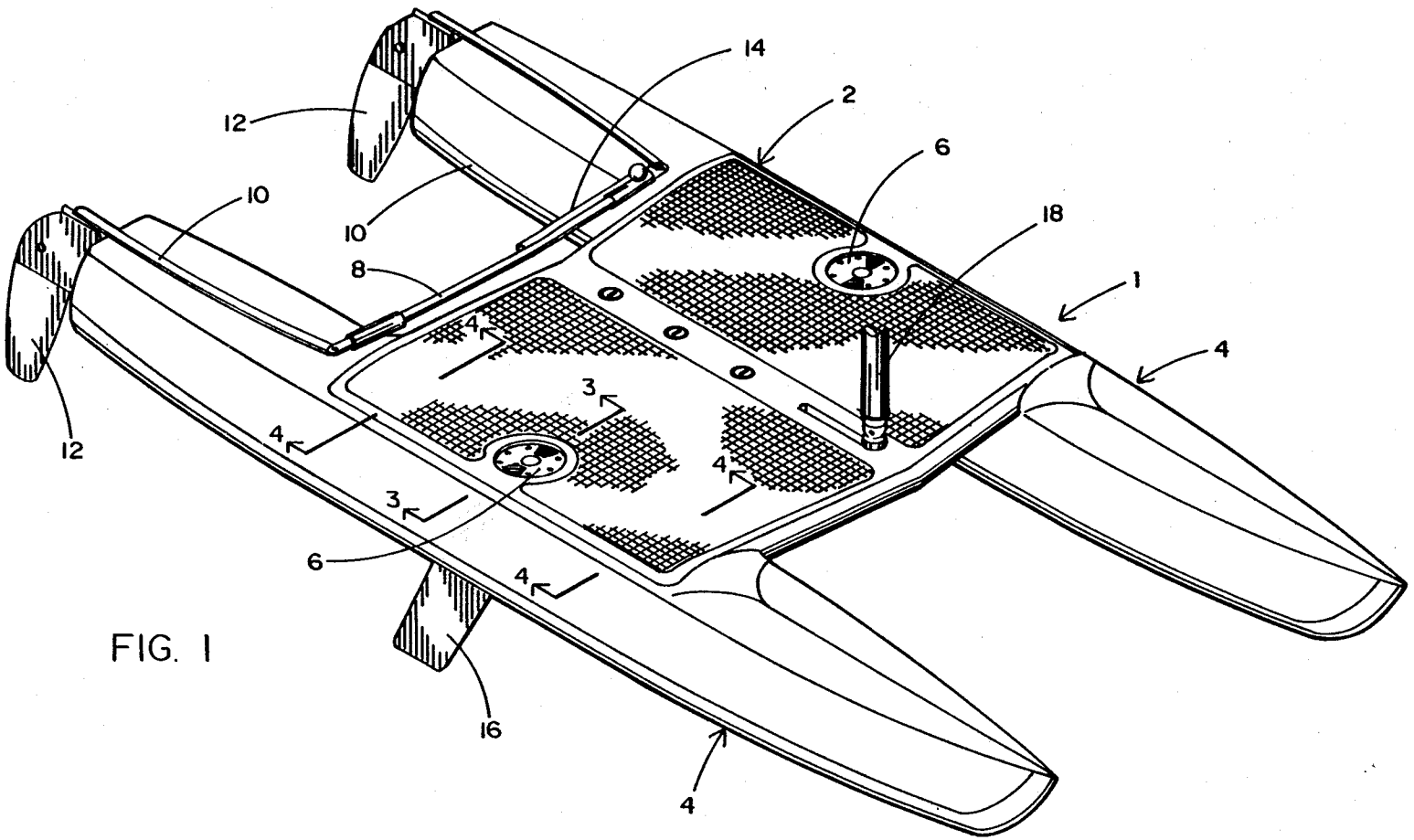
FIG. 1 is an isometric illustration of a sailboat (e.g. a catamaran) which employs the deck connection system of the present invention.

The deck connection system which forms the present invention is best described while referring to the drawings, where FIG. 1 shows a sailboat (e.g. a catamaran 1) including a generally hollow wing 2 having reinforcing internal bulkheads and extending between and detachably connected to a pair of elongated, hollow hulls 4 to complete a sailboat deck. Although a catamaran 1 is illustrated and described herein, this should not be regarded as a limitation, and the claimed invention is also applicable to completing a deck for other sailboats and motor powered boats.

The wing 2 extends continuously between the pair of hulls 4. An anti-slip surface (which is preferably fabricated from a soft urethane foam material) may be recessed into the top of wing 2 so as to enhance footing conditions. Each hull 4 is also fabricated from a rigid, non-corrosive material, such as fiberglas. The wing 2 is provided with a pair of oppositely disposed, removable hatch covers 6 which, as will be described in greater detail when referring to FIGS. 2–4, perform the dual functions of allowing access to be gained to the interior of the hulls 4 and facilitating the detachable connection of the wing 2 to the hulls 4.

Like a conventional catamaran, the catamaran 1 which is shown in FIG. 1 to illustrate the present deck connection system includes a stern mounted tiller system having a laterally extending tiller crossbar 8, a pair of longitudinally extending tiller arms 10 pivotally connected to tiller crossbar 8 and a pair of rudders 12 connected to respective tiller arms 10 and located rearwardly of the hulls 4. A control stick 14 is interconnected to tiller crossbar 8 so as to control the movement of rudders 12 through tiller arms 10 and thereby steer the catamaran 1.

A center board 16 projects downwardly into the water from each hull 4 to stabilize the catamaran 1 and minimize the effects of turbulence. A mast 18 is retained by the wing 2 in order to support one or more sails and associated rigging (not shown) in a manner which is well known in the art of sailboats.

Figure 2:
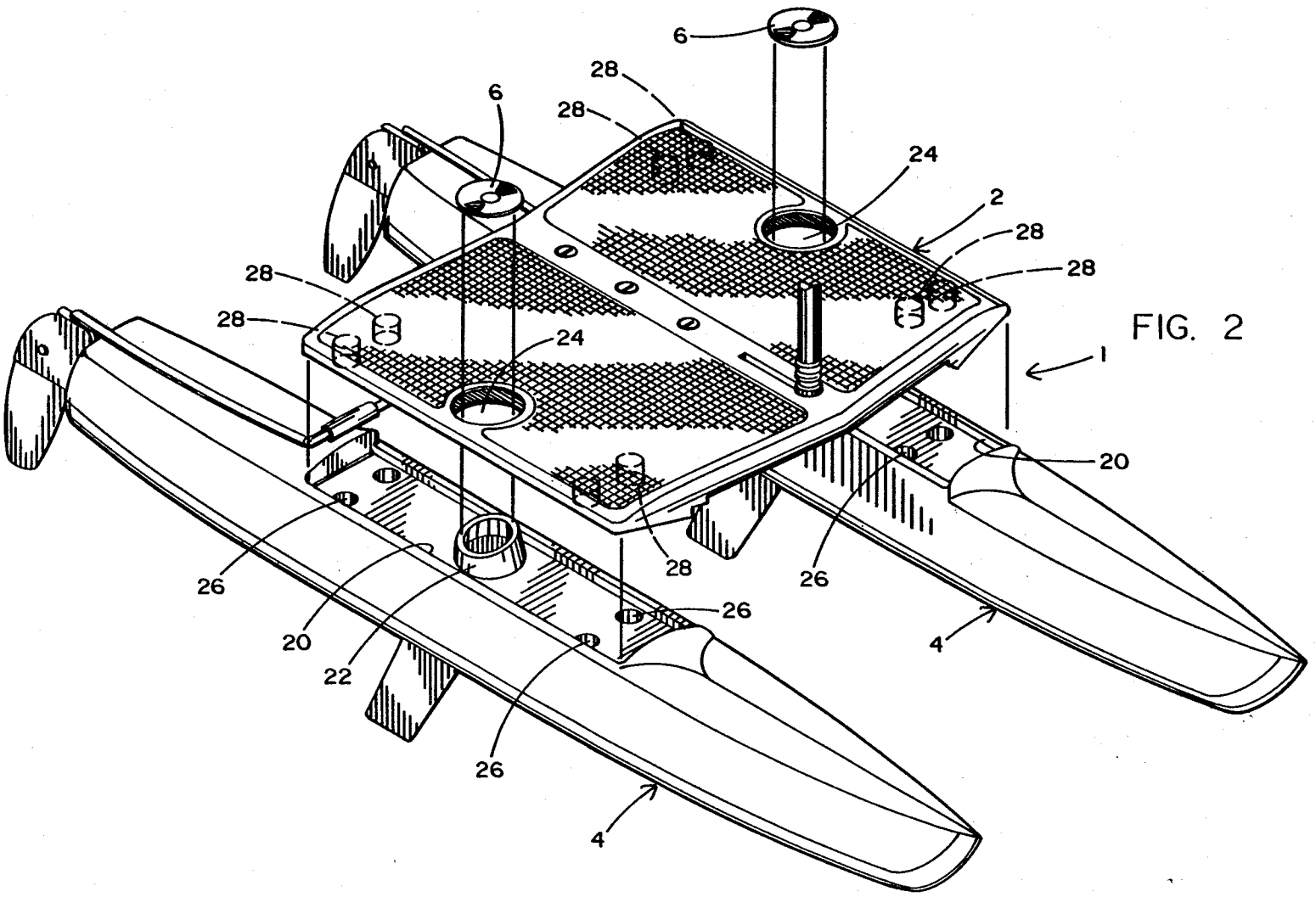
FIG. 2 shows an exploded view of the deck of the sailboat of FIG. 1 so as to illustrate the deck connection system of the present invention.

In FIG. 2 of the drawings, the catamaran 1 is shown with the wing 2 thereof detached from the pair of hulls 4. More particularly, and referring concurrently to FIGS. 2 and 3, each hull 4 is provided with a recessed deck saddle 20. Coextensively formed with and projecting upwardly from each deck saddle 20 is a hollow, open ended hatch cone 22. The hatch cones 22 are sized and shaped to fit through respective hatch openings 24 formed at the port and starboard sides of the wing 2. The receipt of hatch cones 22 through wing hatch openings 24 automatically aligns the wing 2 with the deck saddle 20 of each hull 4, whereby the wing 2 may be easily and reliably mated to the hulls 4 to form a complete deck assembly. Moreover, the receipt of hatch cones 22 through openings 24 also stabilizes the catamaran 1 against torque and torsion producing forces generated by the sea.

Hatch covers 6 are positioned atop respective wing hatch openings 22 to prevent access to the interior of the hollow hulls 4 via the open ended hatch cones 22. That is to say, with the hatch covers 6 removed from wing 2, a sailor may insert his hand through a hatch cone 22 and thereby gain access to the interior of a corresponding hull 4 for the purpose of either using the hull as a convenient storage area or for attaching or detaching the wing 2 to or from the hulls 4 in a manner which will soon be described. To prevent an inadvertent removal of the hatch covers 6, such covers may be provided with screw threads which are adapted to be mated to corresponding screw threads of either the wing 2 or the hatch cones 22. In the assembled configuration (of FIG. 1), the hatch covers 6 are preferably recessed slightly within the wing hatch openings 24 of wing 2.

Referring concurrently now to FIGS. 2 and 4 of the drawings, each hull 4 is shown provided with a suitable plurality of holes extending through the deck saddle 20 thereof. Similarly, a corresponding plurality of screw threaded receptacles 28 are coextensively formed with and extended upwardly and partially through the wing 2 from the bottom thereof. The number and position of the holes 26 and receptacles 28, as illustrated in the drawings, are, for purposes of example, and any suitable number and position may be selected. However, the holes 26 through hulls 4 and the threaded receptacles 28 in wing 2 are aligned with one another for an important purpose which will now be explained.

In order to detachably connect and thereby reliably secure the deck between the hulls 4, and as is best illustrated in FIG. 4, screw threaded fasteners 30 are inserted through respective holes 26 in the saddles 20 of hulls 4. By way of example, each fastener 30 is a bolt that is fabricated by a non-metallic, non-corrosive material, such as PVC. Fasteners 30 are then rotated into engagement with the corresponding screw threads of the wing receptacles 28 in wing 2. It may be desirable to surround the threaded neck of each fastener 30 with a suitable rubber gasket 32, or the like, in order to improve the seal created between the wing 2 and the hulls 4.

The mating of fasteners 30 to wing receptacles 28 provides a non-obtrusive fastening system by which to quickly and efficiently connect the wing 2 to the hulls 4 and thereby complete the deck assembly for the catamaran 1. The foregoing may be relatively easily accomplished by first removing the hatch covers 6 (of FIGS. 2 and 3) so as to enable the sailor to insert his hand and arm through the open ended hatch cones 22 and the wing hatch openings 24 so as to thereby reach and manipulate the fasteners 30 relative to the wing receptacles 28. Since the wing receptacles do not extent completely through the wing 2, the bolts 30 are not visible from the top of the wing. Therefore, the aesthetic appearance of the wing 2 is streamlined and improved inasmuch as the means by which to detachably connect wing 2 to hulls 4 are hidden from view.

While in FIGS. 2 and 4, the holes 26 are shown formed in the hulls 4 and the wing receptacles 28 are shown formed in the bottom of wing 2, it is to be understood that this arrangement may be reversed. That is, threaded female connector members could be formed in the hulls 4 to receive correspondingly threaded male connector members which extend from the wing 2 to connect wing 2 to hulls 4 and thereby complete the deck assembly of catamaran 1.

By virtue of the present invention, a non-deformable, rather than a flexible, wing 2 is located between and connected to a pair of hulls 4. Wing 2 may be quickly and easily detached from the hulls 4 for the purpose of repair, replacement, transport, or storage without the use of special tools, as are frequently required to detach conventional flexible trampolines. Moreover, the rigidity offered by the non-deformable wing 2 provides for a more secure footing and comfortable seating than avialable from the conventional flexible trampoline. What is more, and unlike the spring-like effect associated with the conventional flexible trampoline, the non-deformable wing 2 of this invention increases the structural integrity of the sailboat 1 so as to better withstand and absorb the torsion and torque producing forces generated by the sea, whereby to enhance the aerodynamic and hydrodynamic characteristics of the boat.

It will be apparent that while a preferred embodiment of the invention has been shown and described, various modifications and changes may be made without departing from the true spirit and scope of the invention. Having thus set forth a preferred embodiment of the invention, what is claimed is:

1. A system for connecting a wing to a hollow hull to complete a deck assembly for a boat, said system comprising:

an opening formed through said wing;

an opening formed through said hull to communicate with the hollow interior thereof; and means for attaching said wing to said hull from a location at the interior of said hull, the openings in said wing and said hull being aligned with one another and particularly sized to permit manual access to the hollow interior of said hull via said openings so that said wing can be attached to said hull from a location at the interior of said hull.

2. The connecting system recited in claim 1, further comprising a hollow, open ended member integrally connected to and extending upwardly from the opening in said hull, said open ended member communicating with the interior of said hull and projecting through the opening in said wing for aligning said wing with said hull.

3. The connecting system recited in claim 1, further comprising a cover removably positioned over said opening in said wing for blocking access to the interior of said hollow hull via the openings in said wing and said hull.

4. The connecting system recited in claim 1, wherein said attaching means includes at least one fastener extending between and thereby connecting said wing to said hull.

5. The connecting system recited in claim 4, wherein said hull has a hole extending therethrough and said wing has a receptacle formed therein, said fastener extending through said hole for receipt in said receptacle for connecting said wing to said hull.

6. The connecting system recited in claim 1, wherein said boat having said deck assembly is a sailboat.

7. The connecting system recited in claim 1, wherein said wing is detachably connected to said hull.

8. The connecting system recited in claim 1, wherein said hull has a recessed saddle for receiving said wing therewithin and establishing a flush fit between said hull and said wing, the opening formed through said hull also extending through said saddle for alignment with the opening through said wing to permit manual access to the hollow interior of said hull.

9. A boat having a pair of spaced, hollow hulls and a wing extending between and connected to said hulls by means of a connecting assembly to thereby form a boat deck, said connecting assembly comprising:

a hollow, open ended member extending from each of said hulls and communication with the interior of said hulls;

openings formed through said wing for receipt of said open ended members so that said wing and said hulls may be aligned with one another;

fastening means for attaching said wing to said hulls from a location at the interior of said hulls;

holes formed in said hulls into which respective fastening means can be inserted from the interior of said hulls; and receptacles formed in said wing for receipt of said fastening means inserted through said holes, the open ended members of said hulls and the openings through said wing being particularly sized to permit manual access to the hollow interior of said hulls via said members and said openings so that said fastening means can be inserted into said holes from locations at the interior of said hulls.

10. The boat deck connecting assembly recited in claim 9, wherein said wing is formed from a non-deformable material, said non-deformable wing extending continuously between said pair of hulls.

11. The boat deck connecting assembly recited in claim 9, wherein said fastening means includes bolts extending between each of said hulls and said wing from a location at the interior of said hulls.

12. The boat deck connecting assembly recited in claim 11, wherein said bolts are removable from said receptacles and said holes, whereby said wing is detachable from said hulls.

13. The boat deck connecting assembly recited in claim 9, wherein each of said hulls has a recessed saddle formed therein for receiving respective portions of said wing, said open ended members projecting from said saddles through said openings in said wing and communicating with the interior of said hulls through said saddles.

14. A system for connecting a wing to a hollow hull to complete a deck assembly for a boat, said system comprising:

means for aligning said wing with said hull, said aligning means including a hollow, open ended member extending upwardly from and communicating with the interior of said hollow hull and an opening in said wing for receiving said open ended member therethrough;

means for attaching said wing to said hull from a location at the interior of said hull; and cover means removably positioned over the opening in said wing for blocking access to the interior of said hollow hull via the open ended member of said hull.

* * * * *